US005758422A

United States Patent [19]

Frank

[11] Patent Number: 5,758,422

[45] Date of Patent: Jun. 2, 1998

[54] SCISSORS WITH INTERCHANGEABLE BLADES

[76] Inventor: Lisa Deborah Frank, 65 N. Camino Espaniol, Tucson, Ariz. 85719

[21] Appl. No.: 748,361

[22] Filed: Nov. 13, 1996

[51] Int. Cl.[6] ..... B26B 13/04; B26B 13/10

[52] U.S. Cl. ..... 30/230; 30/260

[58] Field of Search ..... 30/230, 260, 349, 30/254, 231, 232

[56] References Cited

U.S. PATENT DOCUMENTS 4,250,619 2/1981 Buerkert et al. ..... 30/260 X 4,534,109 8/1985 Bush et al. ..... 30/230 X 5,463,814 11/1995 Stowell et al. ..... 30/232

*Primary Examiner*—Douglas D. Watts

*Attorney, Agent, or Firm*—Curtis L. Harrington

[57] ABSTRACT

A scissors with interchangeable blades wherein first and second blade holders are pivoted with respect to each other and each has a manual graspable configuration thereon. On the other end of each blade holder is a blade retainer. Individual blades can be placed in pairs in these blade holders. These pairs of blades have different cooperative configuration so that they can make triangular cuts of different sizes, scallops of different sizes, and other repeating configurations.

23 Claims, 3 Drawing Sheets

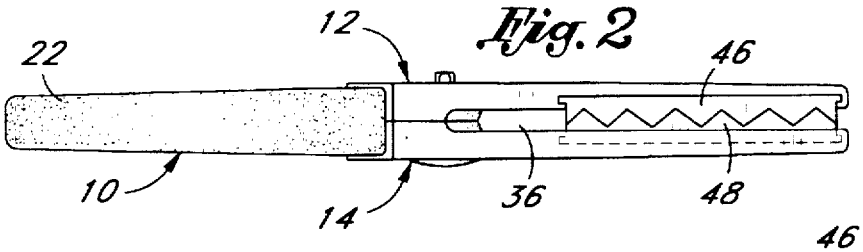
Fig. 2
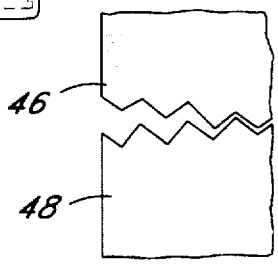
Fig. 6
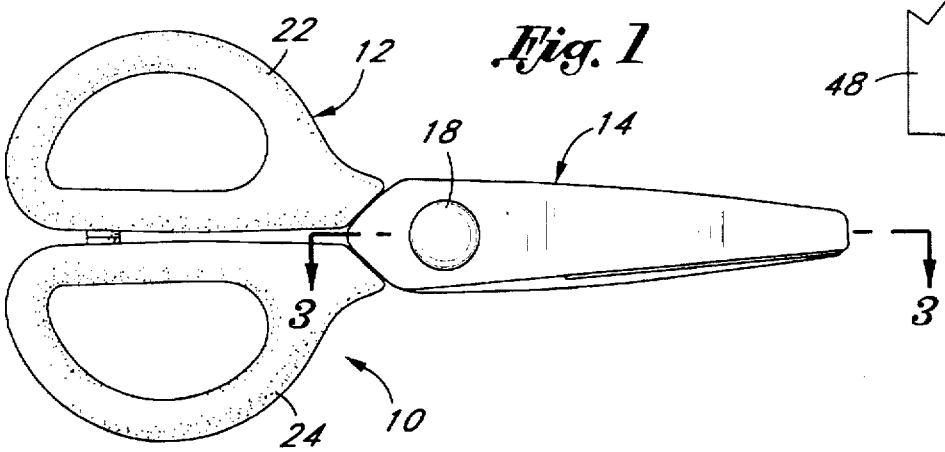
Fig. 1
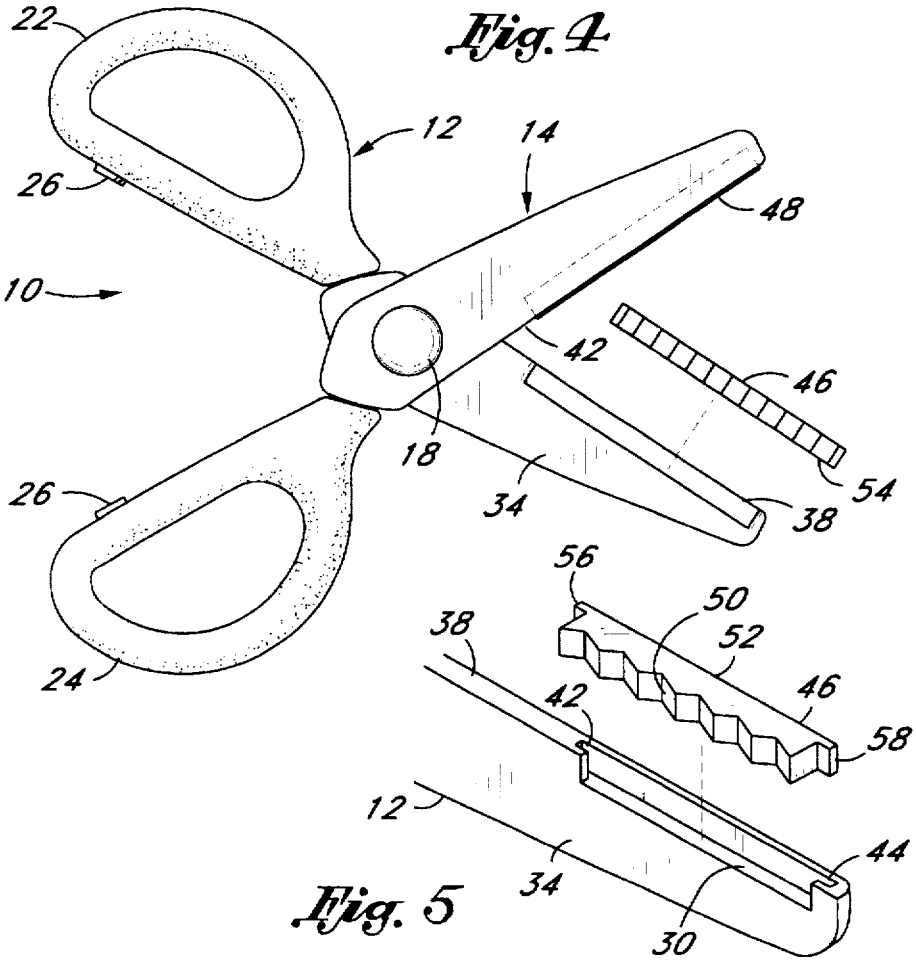
Fig. 4
Fig. 5

SCISSORS WITH INTERCHANGEABLE BLADES

FIELD OF THE INVENTION

This invention is directed to scissors which have interchangeable blades so that the blades may be interchanged in pairs to change the shape of the edge cut by the scissors. The blades may provide E-shaped, square or scalloped configuration, as well as other shapes.

BACKGROUND OF THE INVENTION

Both straight shears and pinking shears are used for the cutting of sheet material. Most commonly, pinking shears are used in the cutting of fabrics to inhibit the unraveling of cut thread on the newly cut edge of the fabric. The non-straight cut of pinking shears prevents long threads from coming out of the woven material. On the other hand, straight shears are used for other types of the cutting of sheet material where the edge raveling is not a problem. Structurally similar to the cloth and paper shears are sheet metal shears, but these are also commonly only available as straight cutting shears.

When decorative edges are desired beyond the triangular notching of ordinary pinking shears, a great deal of handwork and skill is required. Usually, a straight scissors is used and small adjoining cuts are made to achieve the desired decorative edge. There is need for a scissors in which decorative edges can be easily cut without the manual skill and the time required in using a straight-bladed scissors to attempt a similar configuration.

SUMMARY OF THE INVENTION

In order to aid in the understanding of this invention, it can be stated in essentially summary form that it is directed to a scissors with interchangeable blades wherein first and second blade holders are pivoted with respect to each other and each has a manual graspable configuration thereon. On the other end of each blade holder is a blade retainer. Individual blades can be placed in pairs in these blade holders. These pairs of blades have different cooperative configuration so that they can make triangular cuts of different sizes, scallops of different sizes, and other repeating configurations. When the scissors with the selected pair of blades is used to cut sheet material, the corresponding edge shape will be produced.

It is thus a purpose and advantage of this invention to provide a scissors with interchangeable blades so that blades can be selected in accordance with the edge configuration which is desired to be cut.

It is a further purpose and advantage of this invention to provide scissors with interchangeable blades wherein the blades are sufficiently easily interchanged so that children can use them to choose the edge shape desired and install the pair of blades which will produce the selected edge configuration.

It is a further purpose and advantage of this invention to provide a scissors with interchangeable blades which can be readily manufactured so that it may be economically supplied to wide numbers so that it is available to children in their school and play environments.

Other purposes and advantages of this invention will become apparent from a study of the following portion of the specification, the claims and the attached drawings.

BRIEF DESCRIPTION OF THE DRAWINGS

FIG. 1 is a side-elevational view of the scissors with interchangeable blades in accordance with this invention in the closed position.

FIG. 2 is a plan view thereof.

FIG. 4 is a view similar to FIG. 1, but showing the scissors in the open position and showing one of the blades in exploded position.

FIG. 5 is an exploded view of the end of one of the blade holders showing the blade in exploded position with respect thereto.

FIG. 6 is a schematic drawing showing the progressive engagement of the blades.

DESCRIPTION OF THE PREFERRED EMBODIMENT

Figure 3:
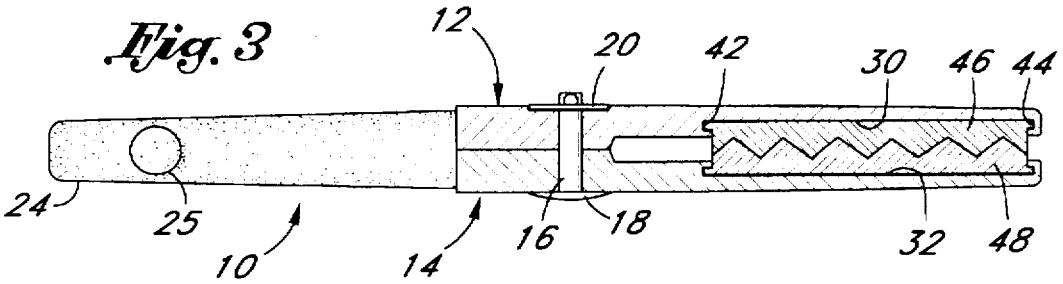
FIG. 3 is a section taken generally along line 3—3 of FIG. 1.
Figure 7:
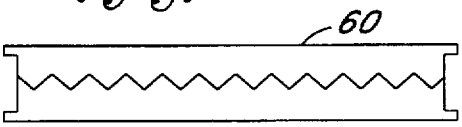
FIG. 7 is an edge view of a second preferred embodiment of the blade holders, showing triangular shaped cutting edges of a smaller size than that shown in FIGS. 2 and 3.
Figure 8:
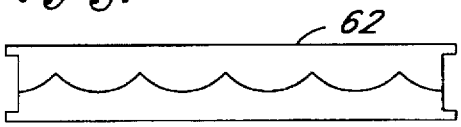
FIG. 8 shows a third preferred embodiment of blades interchangeable in the scissors of this invention, showing scalloped blade edges.
Figure 9:
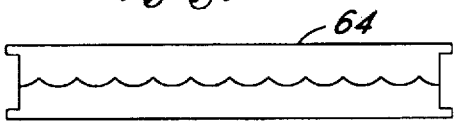
FIG. 9 is a similar view showing a fourth preferred embodiment with scallops of smaller size.

The preferred embodiment of the scissors of this invention is generally indicated at 10 in FIGS. 1, 2, 3 and 4. The scissors 10 is comprised of first and second blade holders 12 and 14. The blade holders are elongated and are pivoted together on pivot pin 16, as seen in FIG. 3. Pivot pin 16 is in the form of a rivet which passes through corresponding holes in the blade holder. The rivet has a head 18 which lies against blade holder 14. The rivet has a washer 20 over which the pin 16 is riveted to permanently retain the blade holders 12 and 14 adjacent each other and pivotally mounted with respect to each other.

To the left of the pivot pin, as the scissors are viewed in FIGS. 1 through 4, the blade holders carry manually graspable structure to permit the blade holders to be rotated around the pivot pin. As seen in FIGS. 1 and 4, the first blade holder 12 carries a thumb loop 22, while the second blade holder 14 carries a finger loop 24. As is well known, the fingers and thumb grasp these loops and open and close the blade holders with respect to each other by pivoting the blade holders around their pivot pin and moving the loops toward and away from each other. The blade holders may be metallic or may be made of rigid synthetic polymer composition material. The covering of the thumb and finger loops is preferably a soft synthetic polymer composition material for a comfortable and secure grasp. The thumb loop 22 and finger loop 24 respectively carry stop members 26 and 28, which define the closed position of the scissors when they are in contact.

The forward portions of the blade holders, on the opposite side of the pivot pin 16 from the thumb and finger loops, extend parallel and spaced from each other. They overlap, as seen in FIG. 1, when the scissors are in the closed position. The forward portions of the blade holders have blade-retaining recesses 30 and 32, respectively. These recesses extend outward from the faces 34 and 36 and into the blade holders from the respective edges 38 and 40. In addition, the retaining recesses have rabbeted notches at their ends. Rabbeted notches 42 and 44 are seen in FIGS. 3 and 5. The retaining recesses with their bottom edges, back faces and rabbeted notches face each other from opposite blade holders, as is seen in FIGS. 2 and 3.

A selected pair of blades can be inserted into the pair of rabbeted notches. FIGS. 2 and 3 show the blades 46 and 48, which can be selected from a large group of pairs of blades for interchangeable insertion into the blade retainers in the blade holders. Other pairs of blades which can be selected are shown in FIGS. 7 through 18. Each pair of blades has a cooperative pair of shear faces of a configuration to cut a selected pattern. The blade pair 46 and 48 cuts a triangular shape, as is conventional in pinking shears. Blade 46 is isometrically shown in FIG. 5 and illustrates that it has a cutting face 50, which is in the shape of triangular ridges. Opposite the cutting face, it has a back 52 which goes into the back of the recess 30. The blade 46 has a bottom surface 54, see FIG. 4, which engages in the bottom of the retaining recess 30 to act as a stop to accommodate the force which is generated in shearing. Additionally, the blade 46 has fingers 56 and 58, which respectively insert into the rabbeted notches 42 and 44. In all, the blade is a sliding fit into the blade retaining recess. It could be inserted and installed with only finger pressure, but is firmly positioned in proper alignment. Since the blade pair 46 and 48 have cooperative surfaces at different angles outward from the pivot pin, the longitudinal distance of the blade pair radially from the pivot pin must also be maintained. When the two blades of the blade pair are inserted into their corresponding retaining recesses, the scissors 10 is ready to be used.

The scissors are manually engaged and opened, and the sheet material to be cut is placed therebetween. As the blades are manually moved toward each other, they progressively cut, as is indicated in FIG. 6. Not all of the shearing is accomplished at one point, but the shearing progressively moves along the length of the blade, as is known in shears. The blades are sufficiently firmly held in their retaining recesses so that, when the scissors are opened and the blades moved away from each other from the position of FIG. 1 to the position of FIG. 4, the blades remain in their recesses.

A significant feature of the present invention is that the blade pair can be removed and replaced with another blade pair so as to cut a different edge configuration in the sheet being sheared by the scissors. Blade pair 60 is another triangular cutting pair which cuts a finer or smaller triangle than the blade pair 46 and 48. The blade pair 62, shown in FIG. 8, has cooperative faces which cut scallops. The blade pair 64, shown in FIG. 9, also cuts scallops, but to a smaller size.

Figure 10:
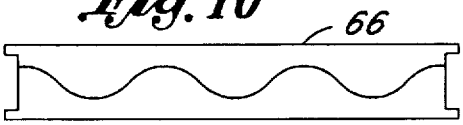
FIG. 10 shows a fifth preferred embodiment wherein the blade has scalloped edges.
Figure 13:
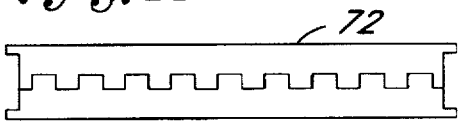
FIG. 13 is an eighth preferred embodiment of the blades pairs which are configured to produce square notched edges.
Figure 11:
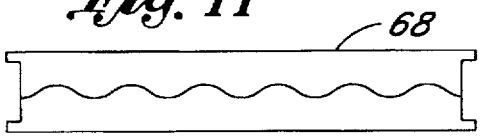
FIG. 11 is a sixth preferred embodiment of the blades, showing scalloped edges of a smaller size.
Figure 12:
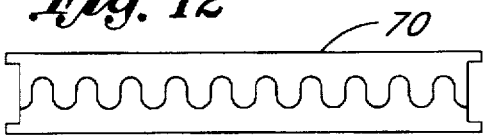
FIG. 12 is a seventh preferred embodiment of the blade pair which produces scalloped edges of a different configuration.

Blade pairs 66, 68 and 70, shown in FIGS. 10, 11 and 12, have faces which cooperate to cut wavy edges. The waves in these three configurations are of different size and shape. The blade pair 72, shown in FIG. 13, is configured to cut square notches. The blade pair 74, shown in FIG. 14, also cuts square notches of a different configuration.

It can be appreciated that the first and second blade pairs rotate with respect to each other on an axis defined by the pivot pin 16. In order to provide progressive cutting along the length of the blades in a direction generally radially outward from the pivot axis, the cutting surfaces of the blades, while planar, are not radial. Particularly in FIG. 4, it can be seen that the top surface of blade 46 is planar, but the plane thereof is parallel to but passes above the rotational axis of pivot pin 16. Similarly, the lower face of blade 48 is planar, and the plane thereof passes below the axis of pivot pin 16. This means that those portions of the blades which are closest to the pivot pin are first to intersect, and the intersection of the planes and the passing of the planar surfaces progressively moves outward to the right from pivot pin 16.

It is understood that, with this directional motion, the faces of the blade pairs which face each other are preferably not planar, but are curves around the axis of pivot pin 16. If they are not such curves, favorable results can be achieved by providing substantial undercut of the facing surfaces below the cutting planes. In this case, the facing surfaces are the configured surfaces of the various blade pairs. Since the scissors act as a shear, only the edges of the planar surfaces with the facing surfaces are active in the cutting operation. This means that the blades can be thin in the direction of cutting. However, they must be sufficiently thick in that direction to provide stability to the blades when they are inserted into the blade holders. It is seen that the shear surfaces are planar and that the under surfaces which engage in the retaining recess 30 are also planar. This makes it inexpensive to manufacture so that more differently shaped blade pairs can be made available at a reasonable price.

Figure 15:
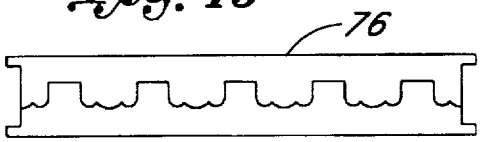
FIG. 15 shows a tenth preferred embodiment of a blade pair which cuts a combination of scalloped and square cuts.
Figure 14:
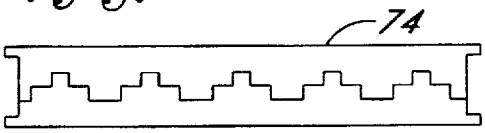
FIG. 14 is a ninth preferred embodiment of a blade pair showing another type of square edge cut.
Figure 16:
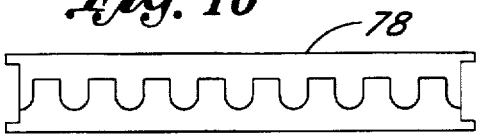
FIG. 16 is an eleventh preferred embodiment of a blade pair showing blades which cut a different combination of square and scalloped cuts.
Figure 17:
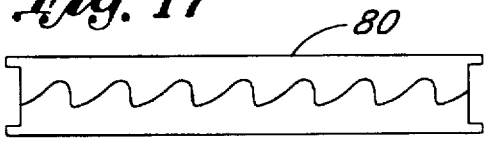
FIG. 17 is a twelfth preferred embodiment of a blade pair showing a curved cut.
Figure 18:
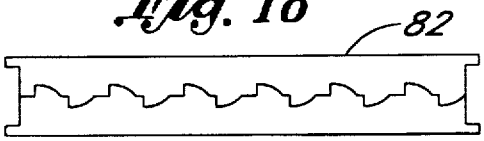
FIG. 18 is a thirteenth preferred embodiment of a blade pair showing a combination cut of curves and straight edges.

FIGS. 15 and 16 show blade pairs 76 and 78 are configured to cut edges with different kinds of combinations of square edges and waves. Blade pairs 80 and 82 are configured to cut other surfaces which are a combination of curves and/or straight lines. Each of the sets of blade pairs 60 through 82 is configured so that it may be placed in the blade retaining recesses in the scissors. When placed therein, the cutting faces of the blade pairs cooperate so that they can cut the edges of sheet material to cut a corresponding shape thereon. Thus, the scissors 10 can be used to cut decorative edges of a wide variety. The blades 46 and 48, as well as the blade pairs 60 through 82 are preferably metallic so as to shear cleanly and have a long cutting life. Hardened and ground high carbon steel or hard stainless steel is often used in scissors blades. Other materials may be found useful for construction of the blade pairs. The material of blades is related to the kind of material intended to be cut. In the present case, paper and polymer sheet material are the anticipated intended use. In this way, scissors with interchangeable blades are created so that artists and artisans can easily and quickly create ornamentally cut edges.

This invention has been described in its presently preferred best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A scissors comprising:

first and second blade holders, said first and second blade holders being pivoted with respect to each other on a pivot axis;

manually graspable means on each of said first and second blade holders so that said first and second blade holders can be rotated with respect to each other around axis;

first and second blade retaining means respectively on said first and second blade holders, and further including a recess in said first blade holder for releaseably retaining said first blade therein and said second blade holder has a recess for releaseably retaining said second blade therein and wherein each of said recess has a rabbeted notch in each end thereof and each said blade has a finger thereon sized to fit within its rabbeted notch so that said blade is held in said blade holder so that it cannot be moved away from said back wall of said recess; ~~and~~ first and second shear blades respectively releasably mounted in said blade retaining means, said first and second shear blades being selected from a plurality of pairs of shear blades, each configured to shear a different configuration in sheet material.

2. The scissors of claim 1 wherein said shear blades are removably mounted in said retaining means on said blade holders.

3. The scissors of claim 2 wherein said selected pair of blades has cooperative shapes on blade faces axially positioned with respect to each other during shearing which are complementary to each other and configured to shear the desired shape.

4. The scissors of claim 3 wherein the complementary configuration comprises a triangle configuration.

5. The scissors of claim 3 wherein said complementary shape comprises a scalloped configuration.

6. The scissors of claim 3 wherein said complementary configuration comprises a wave configuration.

7. The scissors of claim 3 wherein said complementary configuration comprises a square configuration.

8. The scissors of claim 3 wherein said complementary configuration comprises straight lines and curves.

9. The scissors of claim 1 wherein said manually engageable means comprises at least one loop on one of said blade holders for engagement by the fingers.

10. The scissors of claim 9 wherein said manual engagement means is covered with polymer composition material.

11. The scissors of claim 9 wherein said first blade holder carries a manually engageable loop thereon for engagement by the user's fingers and said second blade holder carries a loop thereon for manual engagement by the user's thumb.

12. The scissors of claim 11 wherein said manually engageable loop on said first and second blade holders are each covered with a synthetic polymer composition material.

13. The scissors of claim 1 wherein said recess has a bottom wall for transferring force from said blade to said blade holder resulting from shearing and said recess has a back wall for maintaining each said blade in shearing position.

14. The scissors of claim 13 wherein said first and second blades are respectively frictionally retained in said first and second recesses.

15. A scissors comprising:

first and second blade holders, and wherein each said blade holder has a pair of notches therein and each said blade has a pair of finders for engaging in said notches, said notches preventing withdrawal of each said blade from its retaining recess except in a direction at a right angle to said blade surface;

pivot means interengaging said first and second blade holders so that said first and second blade holders rotate with respect to each other on a pivot axis;

first and second manually engageable means respectively on said first and second blade holders for relative rotation of said first and second blade holders around said pivot axis;

first and second mounting means respectively on said first and second blade holders for detachably holding first and second shear blades respectively, said shear blades each having a shearing face and having contiguous faces which interact when the first and second blades are moved past each other to cut a non-straight line in sheet material.

16. The scissors of claim 15 wherein said retaining means on said first and second blade holders for said first and second blades comprise first and second retaining recesses, said blades being configured to engage in said recesses so that said blades can be removed from said recesses only in the direction opposite shearing forces.

17. The scissors of claim 15 wherein there are first and second retaining recesses respectively on said first and second blade holders for receiving and releasably retaining said first and second blades, said first and second recesses having a bottom against which each said blade rests when in position in said retaining recess, said bottom being positioned to receive shearing forces on said blades.

18. The scissors of claim 17 wherein said recesses also have a wall therein to retain each said blade in said recess in a direction parallel to said axis.

19. The scissors of claim 15 wherein the complementary configuration comprises a triangle configuration.

20. The scissors of claim 15 wherein said complementary shape comprises a scalloped configuration.

21. The scissors of claim 15 wherein said complementary configuration comprises a wave configuration.

22. The scissors of claim 18 wherein said complementary configuration comprises a square configuration.

23. The scissors of claim 18 wherein said complementary configuration comprises straight lines and curves.

* * * * *